US012070065B2

(12) United States Patent
Rosser

(10) Patent No.: US 12,070,065 B2
(45) Date of Patent: Aug. 27, 2024

(54) VAPORIZER DEVICES

(71) Applicant: JUUL Labs, Inc., San Francisco, CA (US)

(72) Inventor: Christopher James Rosser, Cambridge (GB)

(73) Assignee: JUUL Labs, Inc., Washington, DC (US)

( * ) Notice: Subject to any disclaimer, the term of this patent is extended or adjusted under 35 U.S.C. 154(b) by 552 days.

(21) Appl. No.: 17/348,004

(22) Filed: Jun. 15, 2021

(65) Prior Publication Data

US 2021/0307392 A1 Oct. 7, 2021

Related U.S. Application Data

(63) Continuation of application No. PCT/US2019/067191, filed on Dec. 18, 2019.
(Continued)

(51) Int. Cl.
*A24F 40/44* (2020.01)
*A24F 40/10* (2020.01)
(Continued)

(52) U.S. Cl.
CPC ..... *A24F 40/44* (2020.01); *A24F 40/10* (2020.01); *A24F 40/42* (2020.01); *A24F 40/46* (2020.01); *A24F 40/485* (2020.01)

(58) Field of Classification Search
CPC ..... A24F 40/10; A24F 40/46; A24F 40/42; A24F 40/44; A24F 40/40
See application file for complete search history.

(56) References Cited

U.S. PATENT DOCUMENTS

| | | | |
|---|---|---|---|
| 4,947,874 | A | 8/1990 | Brooks et al. |
| 4,947,875 | A | 8/1990 | Brooks et al. |
| 6,909,840 | B2 | 6/2005 | Harwig et al. |
| 8,528,569 | B1 | 9/2013 | Newton |
| 9,004,073 | B2 | 4/2015 | Tucker et al. |

(Continued)

FOREIGN PATENT DOCUMENTS

| | | | |
|---|---|---|---|
| CN | 103717098 | A | 4/2014 |
| CN | 203748667 | U | 8/2014 |

(Continued)

OTHER PUBLICATIONS

PCT/US2019/067191, Dec. 18, 2019, WO2020132079A1.

*Primary Examiner* — Truc T Nguyen
(74) *Attorney, Agent, or Firm* — Mintz, Levin, Cohn, Ferris, Glovsky, and Popeo, P.C.

(57) ABSTRACT

Vaporizer devices are provided. In one exemplary embodiment, the vaporizer device can include a vaporizer body and a cartridge selectively coupled to and removable from the vaporizer body. The vaporizer body includes a cartridge receptacle and a heating element disposed within the cartridge receptacle and affixed to the vaporizer body. The cartridge includes a reservoir chamber and a wicking element that is in fluid communication with the reservoir chamber. The wicking element is configured to draw at least a portion of a vaporizable material from the reservoir chamber. The wicking element and at least a portion of the heating element are brought into direct contact with each other such that at least a portion of the vaporizable material received within the wicking element can be substantially vaporized to form vaporized material. Cartridges for vaporizer devices are also provided.

19 Claims, 8 Drawing Sheets

Related U.S. Application Data

(60) Provisional application No. 62/783,425, filed on Dec. 21, 2018.

(51) Int. Cl.
*A24F 40/42* (2020.01)
*A24F 40/46* (2020.01)
*A24F 40/485* (2020.01)

(56) References Cited

U.S. PATENT DOCUMENTS 9,078,473 B2 7/2015 Worm et al.
9,326,549 B2 5/2016 Hon
9,510,623 B2 12/2016 Tucker et al.
9,549,573 B2 * 1/2017 Monsees ..... H05B 3/04
9,648,908 B1 5/2017 Rinehart et al.
9,681,688 B1 6/2017 Rinehart et al.
9,687,027 B2 6/2017 Poston et al.
9,763,478 B2 9/2017 Cameron et al.
9,770,055 B2 9/2017 Cameron et al.
9,888,723 B2 2/2018 Cameron et al.
9,986,762 B2 6/2018 Alarcon et al.
9,999,250 B2 6/2018 Minskoff et al.
10,039,321 B2 8/2018 Verleur et al.
10,045,567 B2 8/2018 Monsees et al.
10,045,568 B2 8/2018 Monsees et al.
10,058,128 B2 8/2018 Cameron et al.
10,058,130 B2 8/2018 Monsees et al.
10,070,669 B2 9/2018 Monsees et al.
10,076,139 B2 9/2018 Monsees et al.
10,085,481 B2 10/2018 Verleur et al.
10,085,486 B2 10/2018 Cameron
10,104,915 B2 10/2018 Bowen et al.
10,111,470 B2 10/2018 Monsees et al.
10,117,465 B2 11/2018 Monsees et al.
10,117,466 B2 11/2018 Monsees et al.
10,130,123 B2 11/2018 Hatton et al.
10,159,278 B2 12/2018 Minskoff et al.
10,188,148 B2 1/2019 Althorpe et al.
10,201,190 B2 2/2019 Monsees et al.
10,206,429 B2 2/2019 Davis et al.
10,231,486 B2 3/2019 Bowen et al.
10,264,823 B2 4/2019 Monsees et al.
10,292,427 B2 5/2019 Cameron et al.
10,300,225 B2 5/2019 Terry et al.
10,357,060 B2 7/2019 Rostami et al.
10,426,199 B2 10/2019 Turner et al.
10,512,282 B2 12/2019 Bowen et al.
11,571,024 B2 * 2/2023 Biel ..... A24F 40/485
2013/0056013 A1 3/2013 Terry et al.
2013/0087160 A1 4/2013 Gherghe
2014/0283855 A1 9/2014 Hawes et al.
2014/0345635 A1 11/2014 Rabinowitz et al.
2015/0136158 A1 5/2015 Stevens et al.
2015/0217068 A1 8/2015 Wakalopulos
2015/0305409 A1 10/2015 Verleur et al.
2015/0320116 A1 11/2015 Bleloch et al.
2015/0328415 A1 11/2015 Minskoff et al.
2015/0335075 A1 11/2015 Minskoff et al.
2016/0021933 A1 1/2016 Thorens et al.
2016/0044962 A1 2/2016 Thorens et al.
2016/0150824 A1 6/2016 Memari et al.
2016/0150828 A1 6/2016 Goldstein et al.
2016/0278436 A1 9/2016 Verleur et al.
2016/0286865 A1 10/2016 King et al.
2016/0309785 A1 10/2016 Holtz
2016/0309786 A1 10/2016 Holtz et al.
2016/0324217 A1 11/2016 Cameron
2016/0325055 A1 11/2016 Cameron
2016/0331022 A1 11/2016 Cameron
2016/0331023 A1 11/2016 Cameron
2016/0331024 A1 11/2016 Cameron
2016/0331025 A1 11/2016 Cameron
2016/0331026 A1 11/2016 Cameron
2016/0331027 A1 11/2016 Cameron
2016/0331034 A1 11/2016 Cameron
2016/0331859 A1 11/2016 Cameron
2016/0334119 A1 11/2016 Cameron
2016/0334847 A1 11/2016 Cameron
2016/0337141 A1 11/2016 Cameron
2016/0337362 A1 11/2016 Cameron
2016/0337444 A1 11/2016 Cameron
2016/0356751 A1 12/2016 Blackley
2016/0363570 A1 12/2016 Blackley
2016/0363917 A1 12/2016 Blackley
2016/0367925 A1 12/2016 Blackley
2016/0370335 A1 12/2016 Blackley
2017/0006917 A1 1/2017 Alvarez
2017/0018000 A1 1/2017 Cameron
2017/0020188 A1 1/2017 Cameron
2017/0020195 A1 1/2017 Cameron
2017/0020196 A1 1/2017 Cameron
2017/0020197 A1 1/2017 Cameron
2017/0027229 A1 2/2017 Cameron
2017/0042230 A1 2/2017 Cameron
2017/0042231 A1 2/2017 Cameron
2017/0046357 A1 2/2017 Cameron
2017/0046738 A1 2/2017 Cameron
2017/0055588 A1 3/2017 Cameron
2017/0071249 A1 3/2017 Ampolini et al.
2017/0086496 A1 3/2017 Cameron
2017/0086497 A1 3/2017 Cameron
2017/0086503 A1 3/2017 Cameron
2017/0086504 A1 3/2017 Cameron
2017/0091853 A1 3/2017 Cameron
2017/0092106 A1 3/2017 Cameron
2017/0093960 A1 3/2017 Cameron
2017/0093981 A1 3/2017 Cameron
2017/0119058 A1 5/2017 Cameron
2017/0135407 A1 5/2017 Cameron
2017/0135408 A1 5/2017 Cameron
2017/0135409 A1 5/2017 Cameron
2017/0135411 A1 5/2017 Cameron
2017/0135412 A1 5/2017 Cameron
2017/0136193 A1 5/2017 Cameron
2017/0136194 A1 5/2017 Cameron
2017/0136301 A1 5/2017 Cameron
2017/0181474 A1 6/2017 Cameron et al.
2017/0181475 A1 6/2017 Cameron
2017/0185364 A1 6/2017 Cameron
2017/0196273 A1 7/2017 Qiu
2017/0245551 A1 8/2017 Reevell
2017/0258133 A1 * 9/2017 Ampolini ..... H02J 7/00
2017/0258138 A1 9/2017 Rostami et al.
2017/0258140 A1 9/2017 Rostami et al.
2017/0303590 A1 10/2017 Cameron et al.
2017/0303593 A1 10/2017 Cameron et al.
2017/0303594 A1 10/2017 Cameron et al.
2017/0309091 A1 10/2017 Cameron et al.
2017/0332702 A1 11/2017 Cameron et al.
2017/0340014 A1 * 11/2017 Batista ..... A24F 40/485
2017/0367407 A1 12/2017 Althorpe et al.
2018/0020736 A1 1/2018 Silvestrini et al.
2018/0042306 A1 * 2/2018 Atkins ..... A24F 40/50
2018/0056015 A1 3/2018 Shwadchuck
2018/0064174 A1 3/2018 Monsees et al.
2018/0070648 A1 3/2018 Monsees et al.
2018/0092405 A1 4/2018 Monsees et al.
2018/0092406 A1 4/2018 Monsees et al.
2018/0177240 A1 6/2018 Duque et al.
2018/0199627 A1 7/2018 Bowen et al.
2018/0296777 A1 10/2018 Terry et al.
2018/0317557 A1 11/2018 Monsees et al.
2018/0338540 A1 11/2018 Gavrielov et al.
2018/0360129 A1 12/2018 Bowen et al.
2018/0360130 A1 12/2018 Bowen et al.
2019/0000148 A1 1/2019 Atkins et al.
2019/0008212 A1 1/2019 Atkins et al.
2019/0022345 A1 * 1/2019 Kotch ..... A61M 16/145
2019/0037921 A1 2/2019 Kennedy et al.
2019/0059444 A1 2/2019 Cyphert et al.
2019/0069599 A1 3/2019 Monsees et al.
2019/0104767 A1 4/2019 Hatton et al.
2019/0166913 A1 * 6/2019 Trzecieski ..... A61M 15/06

(56) References Cited

U.S. PATENT DOCUMENTS

| | | | | |
|---|---|---|---|---|
| 2019/0373953 | A1 | 12/2019 | Atkins et al. | |
| 2019/0380388 | A1 | 12/2019 | Amorde et al. | |
| 2020/0022417 | A1* | 1/2020 | Atkins | A61M 15/0063 |
| 2020/0029619 | A1* | 1/2020 | Sundberg | A24F 40/10 |
| 2020/0107585 | A1 | 4/2020 | Atkins et al. | |
| 2020/0113245 | A1 | 4/2020 | Rosser et al. | |
| 2020/0114094 | A1 | 4/2020 | Atkins et al. | |
| 2020/0128874 | A1 | 4/2020 | Atkins et al. | |
| 2023/0218836 | A1* | 7/2023 | Atkins | A61M 11/044 128/202.21 |
| 2023/0276848 | A1* | 9/2023 | Li | A24F 40/10 131/329 |
| 2023/0320416 | A1* | 10/2023 | Jang | A24F 40/50 131/329 |

FOREIGN PATENT DOCUMENTS

| | | | | |
|---|---|---|---|---|
| CN | 106998813 | A | 8/2017 | |
| CN | 107708452 | A | 2/2018 | |
| CN | 105473012 | B | 6/2020 | |
| EP | 0358114 | A2 | 3/1990 | |
| JP | 5815559 | B2 | 10/2015 | |
| TW | 201815301 | A | 5/2018 | |
| WO | WO 2003061716 | A1 | 7/2003 | |
| WO | WO 2011146174 | A2 | 11/2011 | |
| WO | WO 2013116558 | A1 | 8/2013 | |
| WO | WO 2016/079152 | * | 5/2016 | A24F 40/40 |
| WO | WO 2016079151 | A1 | 5/2016 | |
| WO | WO 2016090303 | A1 | 6/2016 | |
| WO | WO 2016090955 | A1 | 6/2016 | |
| WO | WO 2016138665 | A1 | 9/2016 | |
| WO | WO 2016179376 | A1 | 11/2016 | |
| WO | WO 2017185051 | A1 | 10/2017 | |
| WO | WO 2017207586 | A1 | 12/2017 | |
| WO | WO 2018029186 | A1 | 2/2018 | |
| WO | WO 2018048813 | A1 | 3/2018 | |
| WO | WO 2018197515 | A1 | 11/2018 | |
| WO | WO 2019232086 | A1 | 12/2019 | |
| WO | WO 2020097570 | A1 | 5/2020 | |

* cited by examiner

VAPORIZER DEVICES

CROSS-REFERENCE TO RELATED APPLICATIONS

This application is a continuation application, filed under 35 U.S.C. § 120, of PCT International Patent Application No. PCT/US19/67191 with an International Filing Date of Dec. 18, 2019, and entitled "Vaporizer Devices," which claims priority to U.S. Provisional Patent Application No. 62/783,425 filed on Dec. 21, 2018, and entitled "Vaporizer Devices," the disclosures of all of which are incorporated herein by reference in their entirety.

TECHNICAL FIELD

The subject matter described herein relates to vaporizer devices, including a disposable vaporizer cartridge.

BACKGROUND

Vaporizer devices, which can also be referred to as vaporizers, electronic vaporizer devices, or e-vaporizer devices, can be used for delivery of an aerosol (for example, a vapor-phase and/or condensed-phase material suspended in a stationary or moving mass of air or some other gas carrier) containing one or more active ingredients by inhalation of the aerosol by a user of the vaporizing device. For example, electronic nicotine delivery systems (ENDS) include a class of vaporizer devices that are battery powered and that can be used to simulate the experience of smoking, but without burning of tobacco or other substances. Vaporizer devices are gaining increasing popularity both for prescriptive medical use, in delivering medicaments, and for consumption of tobacco, nicotine, and other plant-based materials. Vaporizer devices can be portable, self-contained, and/or convenient for use.

In use of a vaporizer device, the user inhales an aerosol, colloquially referred to as "vapor," which can be generated by a heating element that vaporizes (e.g., causes a liquid or solid to at least partially transition to the gas phase) a vaporizable material, which can be liquid, a solution, a solid, a paste, a wax, and/or any other form compatible for use with a specific vaporizer device. The vaporizable material used with a vaporizer device can be provided within a vaporizer cartridge (for example, a separable part of the vaporizer device that contains vaporizable material) that includes an outlet (for example, a mouthpiece) for inhalation of the aerosol by a user.

To receive the inhalable aerosol generated by a vaporizer device, a user may, in certain examples, activate the vaporizer device by taking a puff, by pressing a button, and/or by some other approach. A puff as used herein can refer to inhalation by the user in a manner that causes a volume of air to be drawn into the vaporizer device such that the inhalable aerosol is generated by a combination of the vaporized vaporizable material with the volume of air.

An approach by which a vaporizer device generates an inhalable aerosol from a vaporizable material involves heating the vaporizable material in a vaporization chamber (e.g., a heater chamber) to cause the vaporizable material to be converted to the gas (or vapor) phase. A vaporization chamber can refer to an area or volume in the vaporizer device within which a heat source (for example, a conductive, convective, and/or radiative heat source) causes heating of a vaporizable material to produce a mixture of air and vaporized material to form a vapor for inhalation of the vaporizable material by a user of the vaporizer device.

In some implementations, the vaporizable material can be drawn out of a reservoir and into the vaporization chamber via a wicking element (e.g., a wick). Drawing of the vaporizable material into the vaporization chamber can be at least partially due to capillary action provided by the wicking element as the wicking element pulls the vaporizable material along the wicking element in the direction of the vaporization chamber.

Vaporizer devices can be controlled by one or more controllers, electronic circuits (for example, sensors, heating elements), and/or the like on the vaporizer device. Vaporizer devices can also wirelessly communicate with an external controller for example, a computing device such as a smartphone).

A vaporizer device typically uses an atomizer that heats the vaporizable material and delivers an inhalable aerosol instead of smoke. The atomizer can include a wicking element that conveys an amount of a vaporizable material (along its length) to a part of the atomizer that includes a heating element. In embodiments where the vaporizer device is a two-piece product that includes a vaporizer body and a vaporizer cartridge, the atomizer is generally located within the vaporizer cartridge itself. In order for the atomizer to be activated from a power source, which typically resides within the vaporizer body, electrical contacts are connected to the vaporizer cartridge itself and corresponding electrical receptacles are included within the vaporizer body. Generally, these electrical contacts are gold-plated in order to maintain a consistent connection between the vaporizer cartridge and the vaporizer body. These electrical contacts significantly increase the cost of the vaporizer cartridge, which in most cases is replaced after use.

In other embodiments, the vaporizer device can be a one-piece product in which the heating element of the atomizer is permanently connected to both the electronics and to the wicking element of the device. However, these types of vaporizer devices are typically disposable because the wicking element cannot be replaced as it begins to degrade. The degradation of the wicking element adversely affects device performance, and ultimately renders the device unsafe to use. As a result, the device must be replaced.

Accordingly, vaporizer devices and/or vaporizer cartridges that address one or more of these issues are desired.

SUMMARY

Aspects of the current subject matter relate to vaporizer devices and to vaporizer cartridges for use in a vaporizer device.

In some variations, one or more of the following features may optionally be included in any feasible combination.

In one exemplary embodiment, a vaporizer device is provided and includes a vaporizer body and a cartridge that is selectively coupled to and removable from the vaporizer body. The vaporizer body includes a cartridge receptacle and a heating element, in which the heating element is disposed within the cartridge receptacle and affixed to the vaporizer body. The cartridge includes a reservoir chamber configured to contain a vaporizable material and a wicking element that is in fluid communication with the reservoir chamber. The wicking element is configured to draw at least a portion of the vaporizable material from the reservoir chamber. The wicking element and at least a portion of the heating element are brought into direct contact with each other in response to at least a portion of the cartridge being seated within the cartridge receptacle such that at least a portion of the vaporizable material received within the wicking element is substantially vaporized to form vaporized material in response to activation of the heating element.

In some embodiments, the vaporizer body can include a first airflow path and the cartridge includes a second airflow path that is in fluid communication with the first airflow path. The second airflow path can extend from an inlet to an outlet of the cartridge. The vaporizer body can include at least one inlet that can be configured to substantially allow airflow to pass into the vaporizer body, in which the at least one inlet can be in fluid communication with the first airflow path. The heating element can include a heating portion that can extend from a first surface to a second surface, in which the wicking element can be in direct contact with the first surface. In such embodiments, a portion of the first airflow path can extend adjacent to the second surface of the heating portion.

The heating element can have a variety of configurations. For example, in some embodiments, the heating element can include one or more holes extending therethrough, thereby allowing the vaporized material to travel through the heating element.

In some embodiments, the vaporizer device can include a support structure that is affixed to the vaporizer body, in which the heating element can be coupled to at least a portion of the support structure. In such embodiments, the support structure can include a base and two opposing legs extending from the base. Each of the two opposing legs can be formed in a substantially T-shaped configuration.

In some embodiments, the cartridge can include at least one vent that can be configured to allow airflow to pass into the reservoir chamber.

In some embodiments, the cartridge can include a holding plate having a wicking receptacle defined therein, in which the wicking element can be at least partially disposed within the wicking receptacle. The holding plate can have a variety of configurations. For example, in some embodiments, the holding plate can include at least one dispense opening that can extend through a wall thereof to allow at least a portion of the vaporizable material within the reservoir chamber to pass therethrough and into the wicking receptacle. In some embodiments, the holding plate can include at least one retaining element that can be configured to secure the wicking element to the wicking receptacle. In some embodiments, the holding plate can include at least one vent extending therethrough, in which the at least one vent can be configured to allow airflow to pass into the reservoir chamber.

In another exemplary embodiment, a cartridge for a vaporizer device is provided and includes a reservoir chamber configured to contain a vaporizable material, a wicking element that is in fluid communication with the reservoir chamber, and a holding plate having a wicking receptacle defined therein. The wicking element is configured to draw at least a portion of the vaporizable material from the reservoir chamber. The wicking element is at least partially disposed within the wicking receptacle. The wicking element is configured to be brought into contact with at least a portion of a heating element that is affixed to a vaporizer body such that at least a portion of the vaporizable material received within the wicking element is substantially vaporized to form vaporized material in response to activation of the heating element.

The holding plate can have a variety of configurations. For example, in some embodiments, the holding plate can define a portion of the reservoir chamber. In some embodiments, the holding plate can include at least one dispense opening that can extend through a wall thereof to allow at least a portion of the vaporizable material within the reservoir chamber to pass therethrough and into the wicking receptacle. In some embodiments, the holding plate can include at least one retaining element that can be configured to secure the wicking element to the wicking receptacle. In some embodiments, the holding plate can include at least one vent extending therethrough, in which the at least one vent can be configured to allow airflow to pass into the reservoir chamber.

In another exemplary embodiment, a vaporizer device is provided and includes a vaporizer body that includes a cartridge receptacle and a heating element disposed within the cartridge receptacle and affixed to the vaporizer body. The cartridge receptacle is configured to receive a cartridge that is selectively coupled to and removable from the vaporizer body, in which the cartridge includes a reservoir chamber containing a vaporizable material and a wicking element in fluid communication with the reservoir chamber. The heating element of the vaporizer body being in direct contact with the wicking element of the cartridge when at least a portion of the cartridge is disposed within the cartridge receptacle, and the heating element being configured to generate heat that substantially vaporizes at least a portion of the vaporizable material drawn into the wicking element from the reservoir.

The details of one or more variations of the subject matter described herein are set forth in the accompanying drawings and the description below. Other features and advantages of the subject matter described herein will be apparent from the description and drawings, and from the claims. The claims that follow this disclosure are intended to define the scope of the protected subject matter.

BRIEF DESCRIPTION OF THE DRAWINGS

The accompanying drawings, which are incorporated into and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Figure 1A:
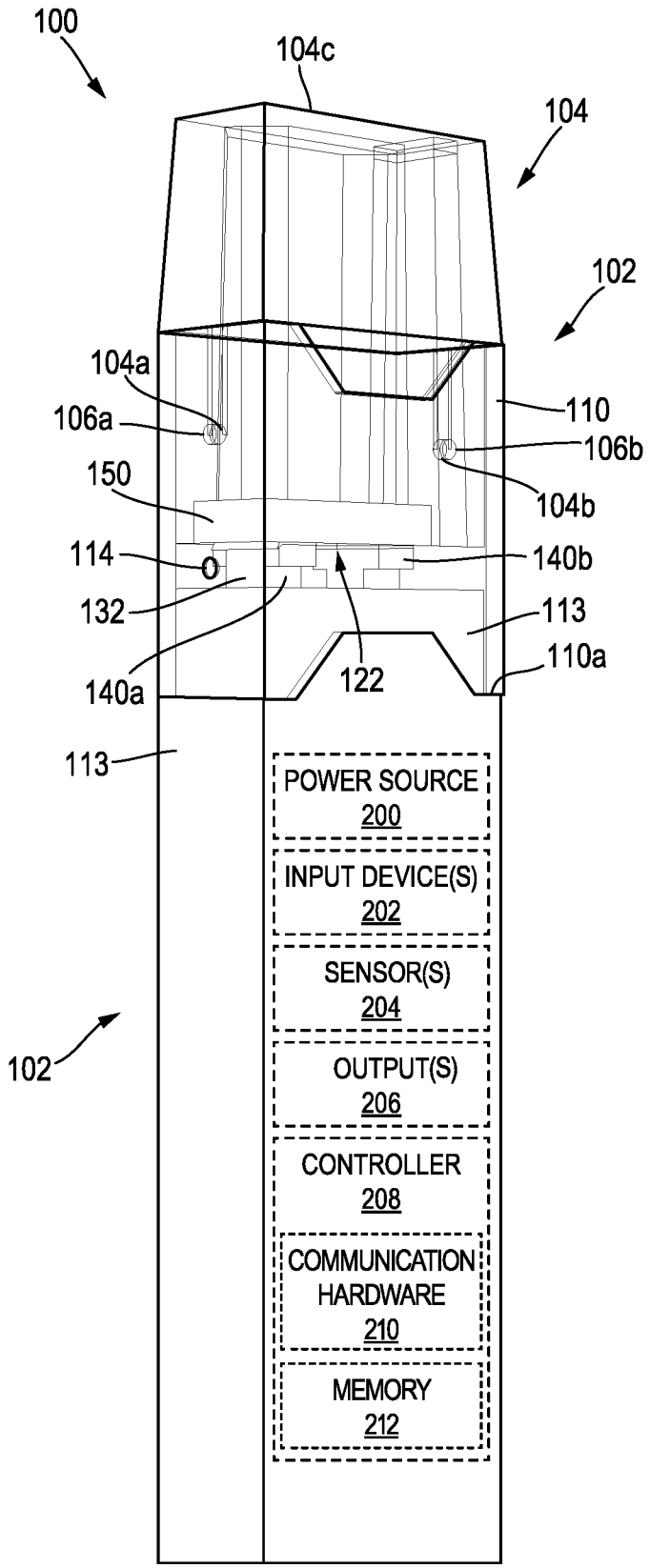
FIG. 1A is a partially transparent, isometric side view of an embodiment of a vaporizer device including a vaporizer body with a heating element disposed therein and coupled to a support structure and a vaporizer cartridge with a wicking element disposed therein.

Implementations of the current subject matter include methods, apparatuses, articles of manufacture, and systems relating to vaporization of one or more materials for inhalation by a user. Example implementations include vaporizer devices and systems including vaporizer devices. The term "vaporizer device" as used in the following description and claims refers to any of a self-contained apparatus, an apparatus that includes two or more separable parts (for example, a vaporizer body that includes a battery and other hardware, and a vaporizer cartridge that includes a vaporizable material), and/or the like. A "vaporizer system," as used herein, can include one or more components, such as a vaporizer device. Examples of vaporizer devices consistent with implementations of the current subject matter include electronic vaporizers, electronic nicotine delivery systems (ENDS), and/or the like. In general, such vaporizer devices are hand-held devices that heat (such as by convection, conduction, radiation, and/or some combination thereof) a vaporizable material to provide an inhalable dose of the material.

The vaporizable material used with a vaporizer device can be provided within a vaporizer cartridge (for example, a part of the vaporizer device that contains the vaporizable material in a reservoir or other container) which can be refillable when empty, or disposable such that a new vaporizer cartridge containing additional vaporizable material of a same or different type can be used).

In some implementations, a vaporizer device can be configured for use with a liquid vaporizable material. For example, the liquid vaporizable material may include a carrier solution in which an active and/or inactive ingredient(s) are suspended or held in solution. Alternatively, the liquid vaporizable material may be a liquid form of the vaporizable material itself. The liquid vaporizable material can be capable of being completely vaporized. Alternatively, at least a portion of the liquid vaporizable material can remain after all of the material suitable for inhalation has been vaporized.

As mentioned above, existing atomizers, which include a wicking element and a heating element, can be entirely disposed within a disposable vaporizer cartridge that is selectively coupled to and removable from the vaporizer body. In such instances, each disposable vaporizer cartridge includes at least one electrical contact that is brought into contact with at least one corresponding electrical contact within the vaporizer body when a vaporizer device is assembled. To ensure a consistent and effective electrical connection is made between the disposable vaporizer cartridge and vaporizer body, these electrical contracts are typically gold plated, which increase the manufacturing cost of the disposable vaporizer cartridges. Alternatively, existing atomizers can be entirely disposed within the vaporizer body itself. However, such configurations impede the user's ability to replace the wicking element. Under such circumstances, the degradation of the wicking element can adversely affect the performance of the vaporizer device and eventually rendering the device unsafe for use. Various features and devices are described below that improve upon or overcome these foregoing issues.

The vaporizer devices described herein utilize a heating element that is disposed within the vaporizer body to produce heat for vaporization of at least a portion of a vaporizable material residing within a vaporizer cartridge that is selectively coupled to and removable from the vaporizer body. That is, the vaporizer body, rather than the vaporizer cartridge, houses the heating element. As a result, this eliminates the need to include electrical contacts within the vaporizer cartridge for electrically coupling the heating element to a power source. Further, this location of the heating element eliminates the need to permanently attach the heating element to both device electronics and to the wicking element, which typically requires the disposal of the entire vaporizer device once the wicking element has been sufficiently degraded. Meanwhile, the wicking element may be disposed within the vaporizer cartridge. Accordingly, the wicking element, which is susceptible to degradation, may be replaced along with the vaporizer cartridge.

The vaporizer devices generally include a vaporizer body with a heating element disposed therein and affixed thereto. The vaporizer cartridge includes a reservoir chamber that is configured to contain a vaporizable material and a wicking element that is in fluid communication therewith. The vaporizer cartridge is selectively coupled to and removable from the vaporizer body to the vaporizer device. As such, when the vaporizer cartridge is coupled to the vaporizer body, the wicking element and at least a portion of the heating element come into direct contact with each other. Subsequently, a user can activate the heating element such that heat is transferred to the wicking element by thermal conduction to vaporize at least a portion of the vaporizable material within the wicking element into a vaporized material.

In some embodiments, the vaporizer body can include a cartridge receptacle that is configured to receive at least a portion of the vaporizer cartridge. In one embodiment, the cartridge receptacle can be defined by a sleeve of the vaporizer body.

The wicking element is configured to at least draw a portion of vaporizable material from the reservoir chamber for vaporization. The wicking element can also optionally allow air to enter the reservoir chamber and replace the volume of vaporizable material removed. In some implementations of the current subject matter, capillary action can pull vaporizable material into the wicking element for vaporization by the heating element, and air can return to the reservoir chamber through the wicking element to at least partially equalize pressure in the reservoir chamber. Other methods of allowing air back into the reservoir chamber to equalize pressure are also within the scope of the current subject matter.

As used herein, the terms "wick" or "wicking element" include any material capable of causing fluid motion via capillary pressure.

The wicking element can be formed of any suitable material that can draw the vaporizable material, e.g., capable of causing fluid motion by capillary action, from the reservoir chamber towards the heating element, such that the vaporizable material can be vaporized by heat delivered therefrom. Non-limiting examples of suitable materials for the wicking element can include one or more ceramic materials, one or more cottons, or one or more polymers. In one embodiment, the wicking element is formed of one or more cottons. Further, the wicking element can have a variety of shapes and sizes. In one embodiment, the wicking element is substantially rectangular shaped. In some embodiments, the wicking element can have a uniform shape and size, whereas in other embodiments, the wicking element can have a varying shape and/or size.

In some embodiments, the wicking element is disposed within a wicking receptacle of a holder plate that is disposed within the vaporizer cartridge. In some embodiments, the holder plate is permanently coupled to the vaporizer cartridge, for example, via bonding materials, such as adhesives and the like. In such embodiments, the wicking element can be selectively coupled to and removable from the holder plate. As a result, a user can remove the wicking element from the holding plate to refill the reservoir chamber with vaporizable material and/or be replaced. In other embodiments, the holder plate can be selectively coupled to and removable from the vaporizer cartridge. In such embodiments, a user can remove the holder plate to refill the reservoir chamber with vaporizable material. Further, the holder plate, and consequently the wicking element, can also be replaced.

The holder plate can have a variety of configurations. In one embodiment, the holder plate can have a substantially rectangular configuration. Further, the holder plate can include at least one dispense opening that extends through a wall thereof to allow at least a portion of the vaporizable material within the reservoir chamber to pass therethrough and into the wicking receptacle, for example, by the capillary action of the wicking element. In one embodiment, upon exposure to the vaporizable material, the wicking element can swell out of the holder plate by at least about 500 microns. In some embodiments, the holding plate can define a portion of the reservoir chamber.

The wicking receptacle can have any configuration that is suitable to house at least a portion of the wicking element. Further, the inner surface(s) of the wicking receptacle can be roughened (e.g., to include one or more retaining elements, such as spikes, barbs, and the like, or other abrasive features) to help secure the wicking element thereto.

The holder plate can include at least one vent that extends through the holding plate thereby allowing a portion of the air traveling along an airflow path of the vaporizer body to enter the reservoir chamber. During use, the influx of air into the reservoir chamber can at least partially maintain an inner pressure (e.g., an inner pressure that is substantially equal to ambient pressure) of the reservoir chamber. That is, the influx of air into the reservoir chamber can at least partially equalize the pressure in the reservoir chamber. As such, the at least one vent can function as a one-way valve and therefore can be used to decrease or eliminate negative pressure that is created as the vaporizable material flows out of the reservoir chamber. The at least one vent can have any suitable shape and size that can allow the passage of air into the reservoir chamber.

In use, when the vaporizer cartridge is coupled into the vaporizer body, the wicking element is brought into direct contact with a first surface of the heating element. The heating element is pressed into thermal contact with the wicking element so as to allow the vaporizable material drawn by the wicking element from the reservoir chamber to be vaporized (e.g., upon activation of the heating element) for subsequent inhalation by a user in a gas and/or a condensed (e.g., aerosol particles or droplets) phase. In some embodiments, the wicking element can be at least partially compressed by the heating element, thereby enhancing the thermal transport therebetween.

The vaporizer device can also include a power source (for example, a battery, which can be a rechargeable battery), and a controller (for example, a processor, circuitry, etc. capable of executing logic) for controlling delivery of heat from the heating element to cause a vaporizable material to be converted from a condensed form (for example, a solid-phase material, such as wax or the like, a liquid, a solution, a suspension, etc.) to the gas phase. The controller can be part of one or more printed circuit boards (PCBs) consistent with certain implementations of the current subject matter.

After conversion of the vaporizable material to the gas phase, at least some of the vaporizable material in the gas phase can condense to form particulate matter in at least a partial local equilibrium with a portion of the vaporizable material that remains in the gas phase. The vaporizable material in the gas phase as well as the condensed phase are part of an aerosol, which can form some or all of an inhalable dose provided by the vaporizer device during a user's puff or draw on the vaporizer device. It should be appreciated that the interplay between the gas phase and condensed phase in an aerosol generated by a vaporizer device can be complex and dynamic, due to factors such as ambient temperature, relative humidity, chemistry, flow conditions in airflow paths (both inside the vaporizer device and in the airways of a human or other animal), and/or mixing of the vaporizable material in the gas phase or in the aerosol phase with other air streams, which can affect one or more physical parameters of an aerosol. In some vaporizer devices, and particularly for vaporizer devices configured for delivery of volatile vaporizable materials, the inhalable dose can exist predominantly in the gas phase (for example, formation of condensed phase particles can be very limited).

The heating element can have a variety of configurations. For example, the heating element can be or include a metal foil or wire, a ceramic heater, or any material that is stable at or above 250° C. Further, the heating element can be configured to be heated using electrical, chemical, or mechanical energy. One type of heating element is a resistive heating element, which can be constructed of, or at least include, a material (e.g., a metal or alloy, such as a nickel-chromium alloy, or a non-metallic resistor) configured to dissipate electrical power in the form of heat when electrical current is passed through one or more resistive segments of the heating element. In other embodiments, the heating element can be, or include, one or more of a conductive heater, a radiative heater, and a convective heater.

In some embodiments, the heating element includes one or more holes extending therethrough. The one or more holes can have any suitable shape and size that allows at least a portion of the vaporized material to travel through the heating element and into an airflow path for subsequent inhalation by a user. In some embodiments, the heating element can be stamped and/or cut from a substrate material, such a conductive material, for example metal and the like.

In some embodiments, the heating element can include a heating portion and at least one leg extending laterally outward from the heating portion. Moreover, the heating portion can include one or more tines having any suitable shape or size. The tine(s) can have a variety of configuration that allow at least a portion of the vaporized material to travel through the heating element and into the airflow path of the vaporizer body for subsequent inhalation by a user.

In some embodiments, the heating element can be coupled to a support structure that is affixed to the vaporizer body. For example, in some embodiments, the support structure is coupled to a chassis that is configured to house at least a portion of additional components of the vaporizer device such as, for example, a power source, input device(s), sensor(s), output, a controller, communication hardware, memory, and the like. The support structure can be configured to provide mechanical support to the heating element during and after manufacturing. The support structure can be formed of any suitable material, e.g., one or more polymers, and the like, using any suitable manufacturing method, e.g., additive manufacturing, and the like.

The support structure can have a variety of configurations. The support structure can be formed of one or more parts. In some embodiments, the support structure is substantially u-shaped. In other embodiments, the support structure can be sized and shaped differently, including any other possible shape. In one embodiment, the support structure includes a base having two opposing legs extending therefrom. The base and the two opposing legs can have variety of configurations, for example, in some embodiments, the base is substantially rectangular shaped and the two opposing legs have a substantially t-shaped configuration. In other embodiments, the base and/or each of the two opposing legs can be sized and shaped differently, including any other possible shape.

The heating element can be activated by a variety of mechanisms. The heating element can be activated (e.g., a controller, which is optionally part of the vaporizer body as discussed herein, may cause current to pass from a power source through a circuit including the heating element), in association with a user puffing (i.e., drawing, inhaling, etc.) directly on the vaporizer cartridge itself, or alternatively, on a mouthpiece coupled thereto, to cause air to flow from an air inlet, along a portion of an airflow path that passes adjacent to a second surface of the heating element. The second surface is opposite the first surface of the heating element that is in contact with the wicking element. As noted herein, the entrained vaporizable material in the gas phase can condense as it passes through the remainder of the airflow path, which also travels through the interior of the vaporizer cartridge (for example, through one or more internal channels therein), such that an inhalable dose of the vaporizable material in an aerosol form can be delivered from an outlet (for example, in the vaporizer cartridge itself and/or in a mouthpiece coupled thereto) for inhalation by a user. In some embodiments, the vaporizer cartridge includes an internal channel extending through the vaporizer cartridge from an inlet to an outlet of the vaporizer cartridge. In one embodiment, a sidewall of the reservoir chamber can at least partially define a sidewall of the internal channel.

Activation of the heating element can be caused by automatic detection of a puff based on one or more signals generated by one or more sensors. The one or more sensors and the signals generated by the one or more sensors can include one or more of: a pressure sensor or sensors disposed to detect pressure along the airflow path relative to ambient pressure (or optionally to measure changes in absolute pressure), a motion sensor or sensors (for example, an accelerometer) of the vaporizer device, a flow sensor or sensors of the vaporizer device, a capacitive lip sensor of the vaporizer device, detection of interaction of a user with the vaporizer device via one or more input devices (for example, buttons or other tactile control devices of the vaporizer device), receipt of signals from a computing device in communication with the vaporizer device, and/or via other approaches for determining that a puff is occurring or imminent.

As discussed herein, the vaporizer device consistent with implementations of the current subject matter can be configured to connect (such as, for example, wirelessly or via a wired connection) to a computing device (or optionally two or more devices) in communication with the vaporizer device. To this end, the controller can include communication hardware. The controller can also include a memory. The communication hardware can include firmware and/or can be controlled by software for executing one or more cryptographic protocols for the communication.

A computing device can be a component of a vaporizer system that also includes the vaporizer device, and can include its own hardware for communication, which can establish a wireless communication channel with the communication hardware of the vaporizer device. For example, a computing device used as part of a vaporizer system can include a general-purpose computing device (such as a smartphone, a tablet, a personal computer, some other portable device such as a smartwatch, or the like) that executes software to produce a user interface for enabling a user to interact with the vaporizer device. In other implementations of the current subject matter, such a device used as part of a vaporizer system can be a dedicated piece of hardware such as a remote control or other wireless or wired device having one or more physical or soft (i.e., configurable on a screen or other display device and selectable via user interaction with a touch-sensitive screen or some other input device like a mouse, pointer, trackball, cursor buttons, or the like) interface controls.

The vaporizer device can also include one or more outputs or devices for providing information to the user. For example, the outputs can include one or more light emitting diodes (LEDs) configured to provide feedback to a user based on a status and/or mode of operation of the vaporizer device. In some aspects, the one or more outputs can include a plurality of LEDs (i.e., two, three, four, five, or six LEDs). The one or more outputs (i.e., each individual LED) can be configured to display light in one or more colors (for example, white, red, blue, green, yellow, etc.). The one or more outputs can be configured to display different light patterns (for example, by illuminating specific LEDs, varying a light intensity of one or more of the LEDs over time, illuminating one or more LEDs with a different color, and/or the like) to indicate different statuses, modes of operation, and/or the like of the vaporizer device. In some implementations, the one or more outputs can be proximal to and/or at least partially disposed within a bottom end region of the vaporizer device. The vaporizer device may, additionally or alternatively, include externally accessible charging contacts, which can be proximate to and/or at least partially disposed within the bottom end region of the vaporizer device.

In the example in which a computing device provides signals related to activation of the resistive heating element, or in other examples of coupling of a computing device with the vaporizer device for implementation of various control or other functions, the computing device executes one or more computer instruction sets to provide a user interface and underlying data handling. In one example, detection by the computing device of user interaction with one or more user interface elements can cause the computing device to signal the vaporizer device to activate the heating element to reach an operating temperature for creation of an inhalable dose of vapor/aerosol. Other functions of the vaporizer device can be controlled by interaction of a user with a user interface on a computing device in communication with the vaporizer device.

The temperature of a resistive heating element of the vaporizer device can depend on a number of factors, including an amount of electrical power delivered to the resistive heating element and/or a duty cycle at which the electrical power is delivered, conductive heat transfer to other parts of the electronic vaporizer device and/or to the environment, latent heat losses due to vaporization of the vaporizable material from the wicking element, and convective heat losses due to airflow (i.e., air moving across the heating element when a user inhales on the vaporizer device). As noted herein, to reliably activate the heating element or heat the heating element to a desired temperature, the vaporizer device may, in some implementations of the current subject matter, make use of signals from the sensor (for example, a pressure sensor) to determine when a user is inhaling. The sensor can be positioned in the airflow path and/or can be connected (for example, by a passageway or other path) to an airflow path containing an inlet for air to enter the vaporizer device and an outlet via which the user inhales the resulting vapor and/or aerosol such that the sensor experiences changes (for example, pressure changes) concurrently with air passing through the vaporizer device from the air inlet to the air outlet. In some implementations of the current subject matter, the heating element can be activated in association with a user's puff, for example by automatic detection of the puff, or by the sensor detecting a change (such as a pressure change) in the airflow path.

The sensor can be positioned on or coupled to (i.e., electrically or electronically connected, either physically or via a wireless connection) the controller (for example, a printed circuit board assembly or other type of circuit board). To take measurements accurately and maintain durability of the vaporizer device, it can be beneficial to provide a seal resilient enough to separate an airflow path from other parts of the vaporizer device. The seal, which can be a gasket, can be configured to at least partially surround the sensor such that connections of the sensor to the internal circuitry of the vaporizer device are separated from a part of the sensor exposed to the airflow path. The seal can also separate parts of one or more electrical connections between the vaporizer body and the vaporizer cartridge. Such arrangements of the seal in the vaporizer device can be helpful in mitigating against potentially disruptive impacts on vaporizer components resulting from interactions with environmental factors such as water in the vapor or liquid phases, other fluids such as the vaporizable material, etc., and/or to reduce the escape of air from the designated airflow path in the vaporizer device. Unwanted air, liquid or other fluid passing and/or contacting circuitry of the vaporizer device can cause various unwanted effects, such as altered pressure readings, and/or can result in the buildup of unwanted material, such as moisture, excess vaporizable material, etc., in parts of the vaporizer device where they can result in poor pressure signal, degradation of the sensor or other components, and/or a shorter life of the vaporizer device. Leaks in the seal can also result in a user inhaling air that has passed over parts of the vaporizer device containing, or constructed of, materials that may not be desirable to be inhaled.

The vaporizer cartridge can be selectively coupled to and removable from the vaporizer body using a coupling mechanism. For example, the vaporizer body and the vaporizer cartridge can each include corresponding coupling elements that are configured to releasably engage with each other. That is, in use, once a predetermined length of the vaporizer cartridge is inserted into the vaporizer body, the coupling elements can engage with each other, thereby securing the vaporizer cartridge to the vaporizer body. Likewise, once the vaporizer cartridge needs to be replaced, the coupling element can disengage allowing the vaporizer cartridge to be removed. And subsequently, a new vaporizer cartridge can be coupled to the vaporizer body.

The position of the coupling elements can be dependent at least upon the desired length of vaporizer cartridge to be inserted into the vaporizer body, for example, to avoid the heating element from damage caused by an insertion force. In one embodiment, the positioning of the coupling elements allows the vaporizer cartridge to be inserted into the vaporizer body until it reaches about 100 microns from the heating element.

In one example of coupling elements for coupling the vaporizer cartridge to the vaporizer body, the vaporizer body can include one or more detents (for example, dimples, protrusions, etc.) protruding inwardly from an inner surface of the cartridge receptacle, additional material (such as metal, plastic, etc.) formed to include a portion protruding into the cartridge receptacle, and/or the like. One or more exterior surfaces of the vaporizer cartridge can include corresponding recesses that can fit and/or otherwise snap over such detents or protruding portions when the vaporizer cartridge is inserted into the cartridge receptacle on the vaporizer body. When the vaporizer cartridge and the vaporizer body are coupled (e.g., by insertion of the vaporizer cartridge into the cartridge receptacle of the vaporizer body), the detents or protrusions of the vaporizer body can fit within and/or otherwise be held within the recesses of the vaporizer cartridge, to hold the vaporizer cartridge in place when assembled. Such an assembly can provide enough support to hold the vaporizer cartridge in place to ensure good contact between the wicking element and the heating element, while allowing release of the vaporizer cartridge from the vaporizer body when a user pulls with reasonable force on the vaporizer cartridge to disengage the vaporizer cartridge from the cartridge receptacle. In other embodiments, the exterior surfaces of the vaporizer cartridge can include the one or more detents and the cartridge receptacle can include the one or more recesses.

In some implementations, the vaporizer cartridge, or at least an end of the vaporizer cartridge configured for insertion in the cartridge receptacle, can have a non-circular cross section transverse to the axis along which the vaporizer cartridge is inserted into the cartridge receptacle. For example, the non-circular cross section can be approximately rectangular, approximately elliptical (i.e., have an approximately oval shape), non-rectangular but with two sets of parallel or approximately parallel opposing sides (i.e., having a parallelogram-like shape), or other shapes having rotational symmetry of at least order two. In this context, approximate shape indicates that a basic likeness to the described shape is apparent, but that sides of the shape in question need not be completely linear and vertices need not be completely sharp. Rounding of both or either of the edges or the vertices of the cross-sectional shape is contemplated in the description of any non-circular cross section referred to herein.

In some embodiments, the vaporizer device can include elements or systems configured for condensate management. Non-limiting examples include a condensate collector and/or a condensate recycle system. For example, the condensate collector can act on vaporized vaporizable material that are cooled and turned into droplets to collect and route the condensed droplets to condensate recycler channels (e.g., micro-fluidic channels) that can be formed to travel from the outlet of the cartridge, or alternatively, an opening in a mouthpiece coupled to the cartridge, to the wicking element, for example. The condensate recycler channels collect and return condensate and large vapor droplets to the wicking element, and prevent the liquid vaporizable material formed in the outlet of the cartridge, or alternatively, in the opening of the mouthpiece if present, from being deposited into the user's mouth, during a user's puffing or inhaling on the cartridge, or alternatively, on the mouthpiece if present. The condensate recycler channels may be implemented as microfluidic channels to trap any liquid droplet condensates and thereby eliminate the direct inhalation of vaporizable material, in liquid form, and avoid an undesirable sensation or taste in the user's mouth. The condensate recycler channels may thus assist in controlling, collecting, and/or recycling condensate in a vaporizer device. Microfluidic fins may be provided that define one or more capillary channels through which fluid is collected via a capillary force formed when fluid is positioned within the capillary channels. To keep the fluid trapped by the finned condensate collector without being extracted by the drag force of the airflow, the capillary force of the microfluidic fins may be greater than the airflow drag force by providing narrow grooves or channels in which the fluid becomes positioned.

Under certain circumstances, instead of vaporizing, one or more components in the vaporizable material can instead form one or more deposits on an exterior surface of the heating element. Accordingly, it can be desirable for the vaporizer device to include one or more components that can be configured to at least partially remove the one or more deposits (e.g., the wicking element). In one embodiment, the wicking element can be configured to at least partially remove the one or more deposits upon the insertion and/or the removal of the vaporizer cartridge relative to the vaporizer body.

Figure 1B:
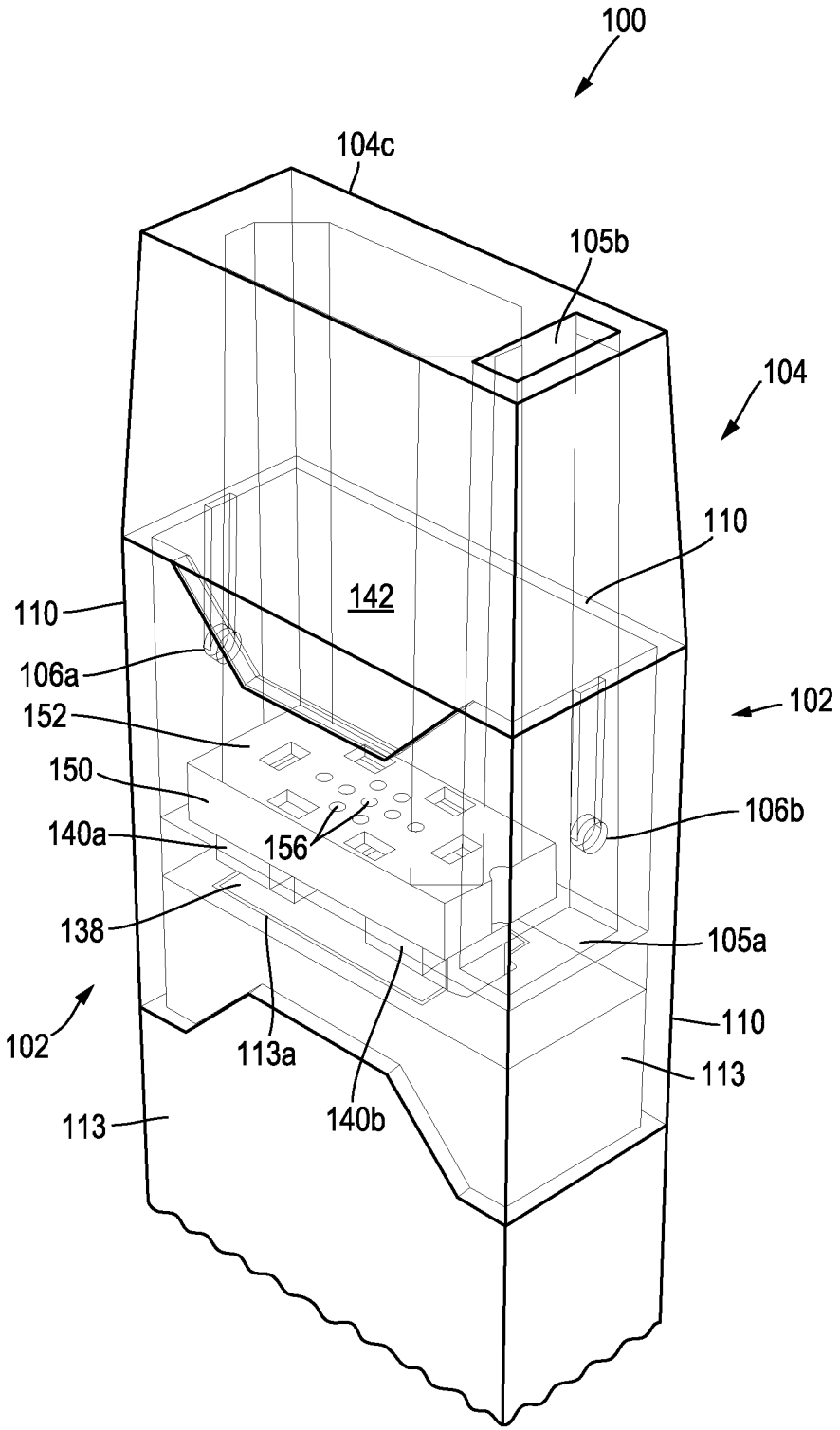
FIG. 1B is another partially transparent, isometric side view of the vaporizer device of FIG. 1A.

FIGS. 1A-1B illustrate an exemplary vaporizer device 100. More specifically, the vaporizer device 100 includes a vaporizer body 102 and a vaporizer cartridge 104 coupled thereto. For purposes of simplicity only, certain components of the vaporizer device 100 are not illustrated.

The vaporizer body 102 and the vaporizer cartridge 104 can be coupled to each other by way of corresponding coupling elements. For example, as shown in FIGS. 1A-3 and 7-8, the vaporizer body 102 includes a first set of coupling elements 106*a*, 106*b* and the vaporizer cartridge 104 includes a second set of corresponding coupling elements 108*a*, 108*b*. While the first and second set of coupling elements 106*a*, 106*b*, 108*a*, 108*b* can have a variety of configurations, in this illustrated embodiment, the first set of coupling elements 106*a*, 106*b* include two recess channels extending inward into the vaporizer body 102 and the second set of coupling elements 108*a*, 108*b* include two protrusions extending outwardly from two opposing sidewalls 104*a*, 104*b* of the vaporizer cartridge 104.

The vaporizer body 102 can have a variety of configurations. As shown in FIGS. 1A-3, the vaporizer body 102 includes a sleeve 110 that extends from a distal end 110*a* to a proximal end 110*b*. The sleeve 110 defines a cartridge receptacle 112 within the vaporizer body 102 that is configured to receive at least a portion of the vaporizer cartridge 104. The distal end 110*a* of the sleeve 110 is coupled to a chassis 113 of the vaporizer body 102. The chassis 113 is configured to house at least a portion of additional components of the vaporizer device 100, such as, for example, any of the components discussed above (e.g., a power source, input device(s), sensor(s), output(s), a controller, communication hardware, memory, and the like). In this illustrated embodiment, the vaporizer device 100 includes a power source 200, input device(s) 200, sensor(s) 204, output(s) 206, a controller 208, communication hardware 210, memory 212, which, as shown in FIG. 1A, are disposed within the vaporizer body 102.

Further, an air inlet 114 extends through a wall 111 of the sleeve 110. This air inlet 114 is configured to allow ambient air 116 to enter the vaporizer device 100. In use, when a user puffs directly on an end 104*c* of the vaporizer cartridge 104, ambient air 116 enters the vaporizer body 102 and travels through a first airflow path 118. Alternatively, a mouthpiece (not shown) can be coupled to the end 104*c* of the vaporizer cartridge 104, in which case the user can puff on the mouthpiece rather than directly on the end 104*c* of the vaporizer cartridge 104. As described in more detail below, vaporized material joins the first airflow path 118 and combines with the air 116 to form a mixture. The mixture travels through the remaining portion of the first airflow path 118 and then through a second airflow path 120 that extends through the vaporizer cartridge 104. As such, the first and second airflow paths 118, 120 are in fluid communication with each other.

Figure 2:
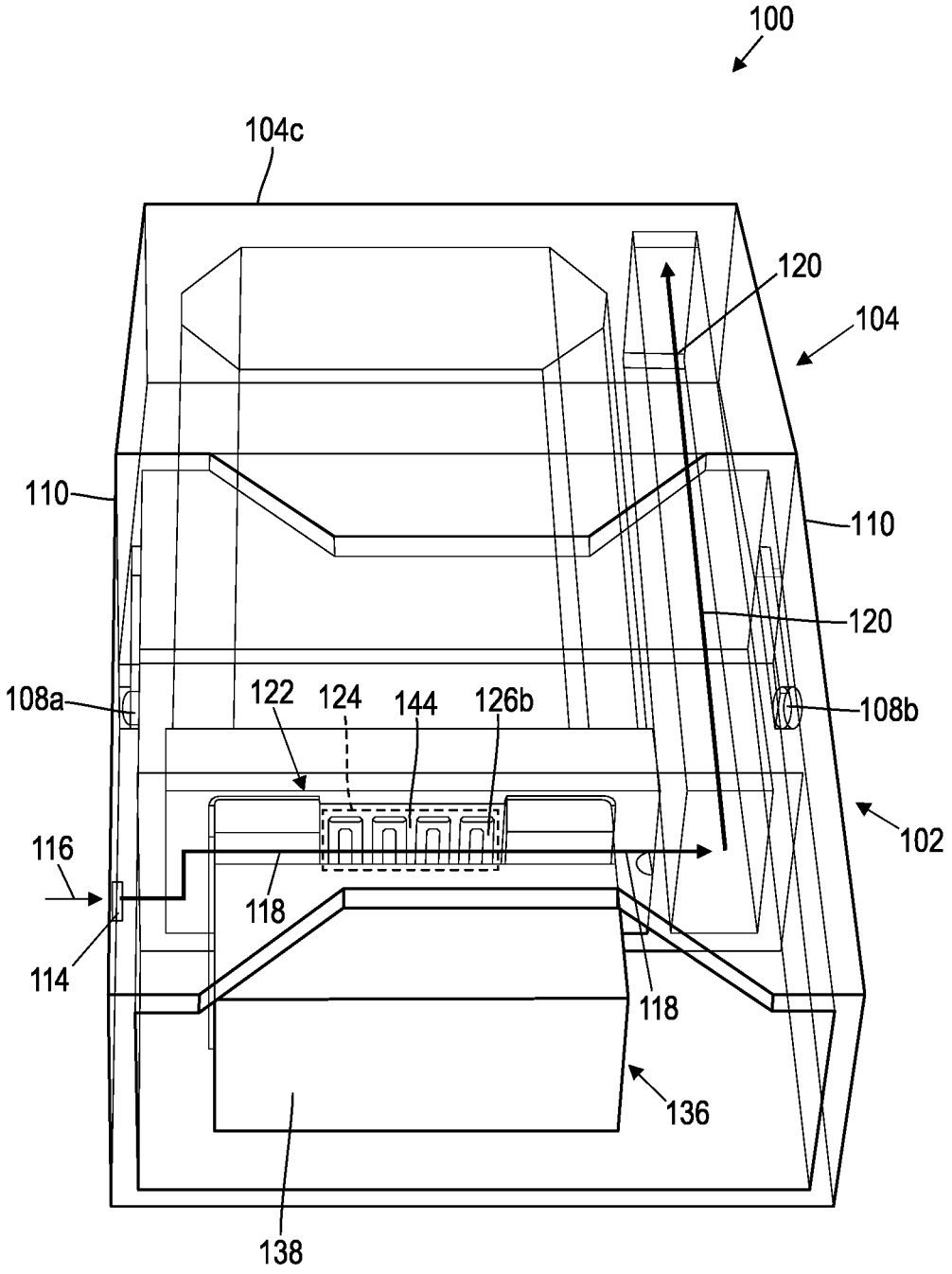
FIG. 2 is a partially transparent, bottom-up isometric view of the vaporizer device of FIGS. 1A-1B with a chassis of the vaporizer body removed.
Figure 3:
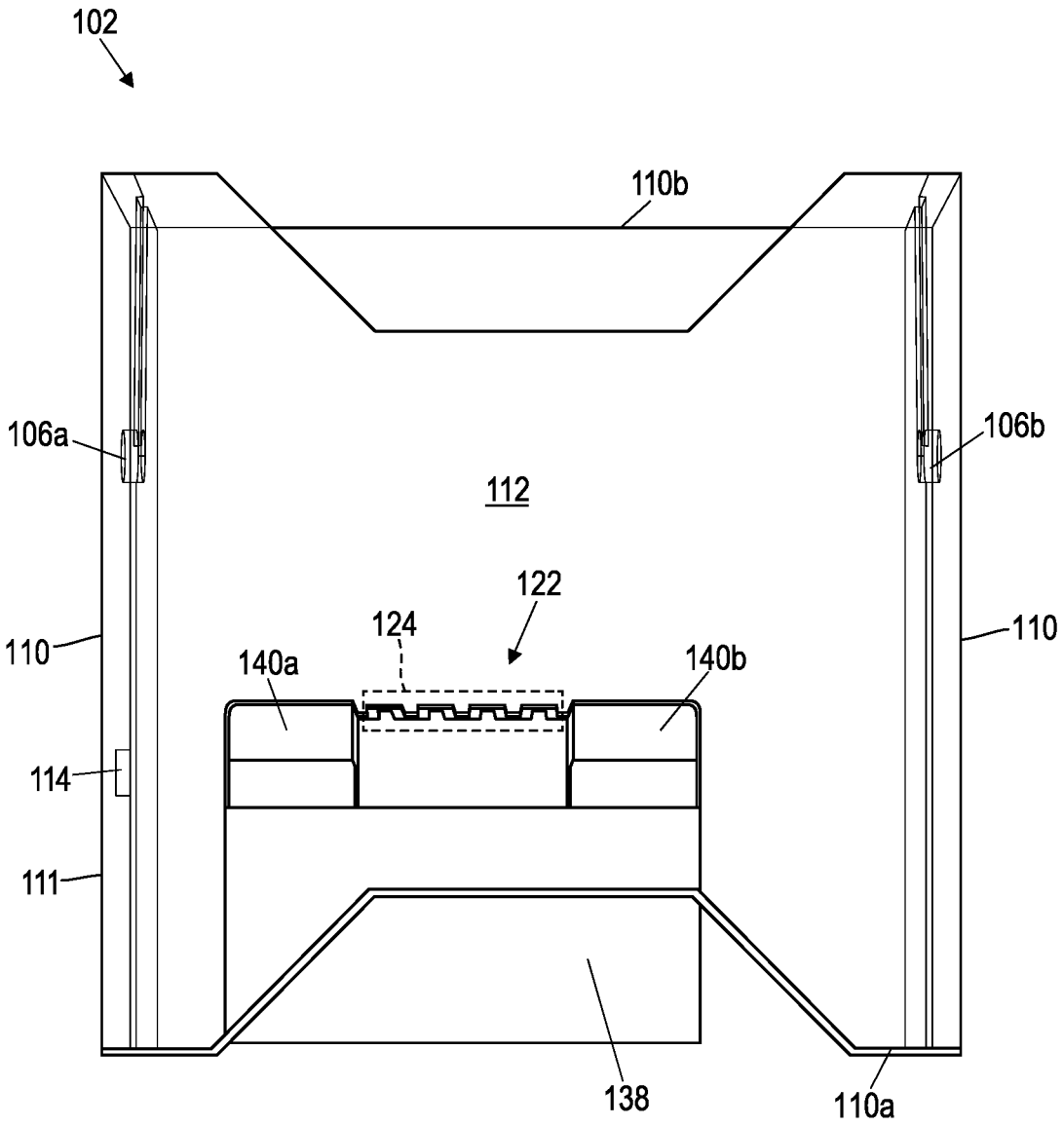
FIG. 3 is a partially transparent, bottom up view of a portion of the vaporizer body of FIGS. 1A-1B.

The vaporizer body 102 also includes a heating element 122 that is disposed within the cartridge receptacle 112. While the heating element 122 can have variety of configurations, the heating element 122, as shown in FIGS. 2-6, includes a heating portion 124 that extends from a first surface 126*a* to a second, opposing surface 126*b*. The heating portion 124 includes tines 130 that extend between first and second ends 128*a*, 128*b* of the heating portion 124. The tines 130 may include various shapes, sizes, and configurations. As shown, each of the tines 130 have the same size and shape. In other embodiments, each of the tines 130 can be sized and shaped differently, including any possible shape. The tines 130 are spaced relative to each other to create passageways or holes through the heating element 122 to allow vaporized material to travel through the heating element 122 and into the first airflow path 118, a portion of which travels adjacent to the second surface 126*b* of the heating portion 124 as shown in FIG. 2.

Figure 4:
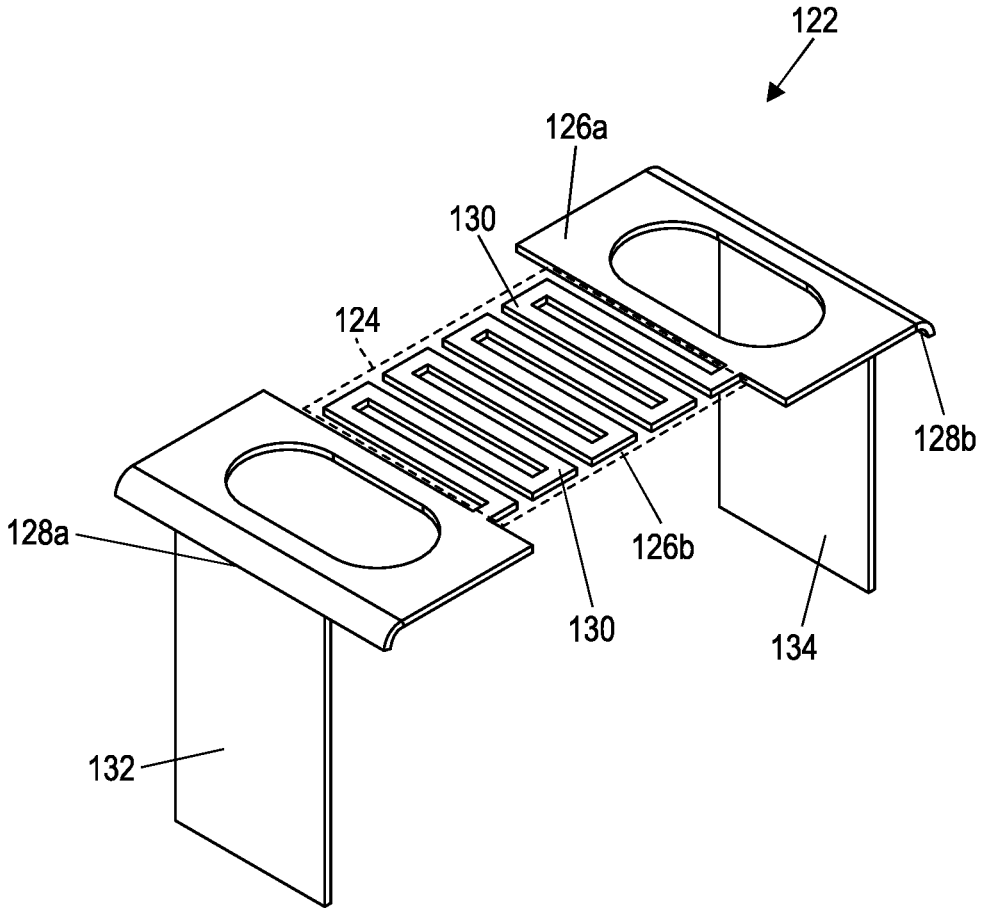
FIG. 4 is an isometric view of the heating element of FIG. 1A.
Figure 5:
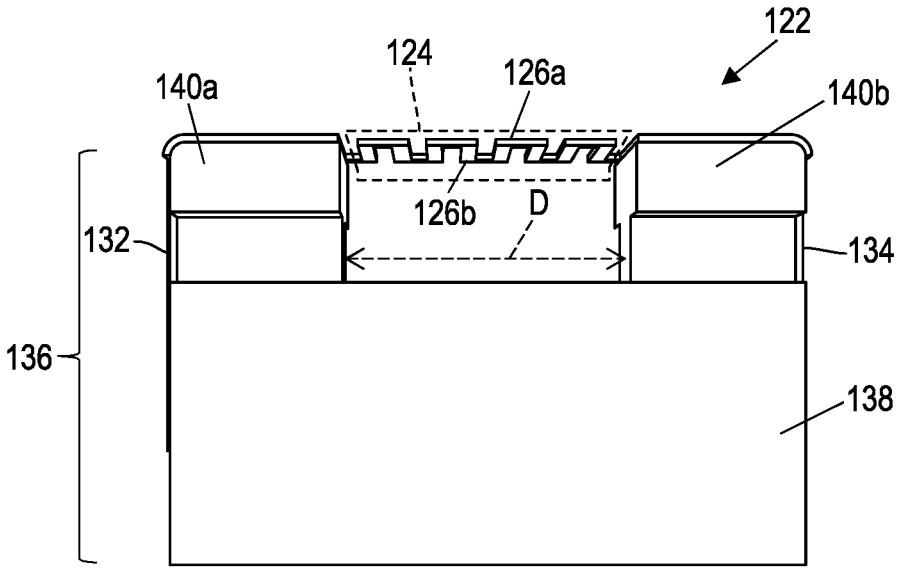
FIG. 5 is an isometric side view of the heating element and support structure of FIG. 1A.

As shown in more detail in FIG. 4, the heating element 122 includes a first leg 132 and a second leg 134, which may extend laterally outward from the first end 128*a* and the second end 128*b* of the heating portion 124, respectively. Each leg 132, 134 forms a portion of the heating element 122 that has a width that is typically wider than a width of each of the tines 130. The first and second legs 132, 134 provide rigidity to encourage the heating element 122 to be mechanically stable during and after manufacturing. Further, electrical contacts (not shown) can be attached to the legs 132, 134 so as to operatively couple the heating element 122 to at least the power source 200 disposed within the vaporizer body 102. The electrical contacts can have a variety of configurations. For example, in one embodiment, the electrical contacts are in the form of wires.

Further, the vaporizer device 100 can include a support structure 136. As shown, as shown in FIGS. 1A-3 and 5-6, the heating element 122 is coupled to at least a portion of the support structure 136. The support structure 136 is disposed within and fixedly coupled to a cavity 113*a* of the chassis 113 (see FIG. 1B). As a result, the heating element 122 is affixed to the vaporizer body 102, and therefore is not part of the vaporizer cartridge 104.

The support structure 136 can have a variety of configurations. In this illustrated embodiment, the support structure 136 includes a base 138 and first and second opposing legs 140*a*, 140*b* extending outwardly from the base 138 and spaced apart relative to each other at a distance (D). While the base 138 and the first and second opposing legs 140*a*, 140*b* can have a variety of configurations, as shown in FIGS. 2-3, and 5-6, the base 138 is substantially rectangular in shape, and each of the first and second opposing legs 140*a*, 140*b* have a substantially t-shaped configuration. Further, as shown, the first and second opposing legs 140*a*, 140*b* are sized and shaped the same. In other embodiments, the first and second opposing legs 140*a*, 140*b* can be sized and shaped differently relative to each other. As shown, the base 138 and the first and second opposing legs 140*a*, 140*b* are integrally formed.

Figure 6:
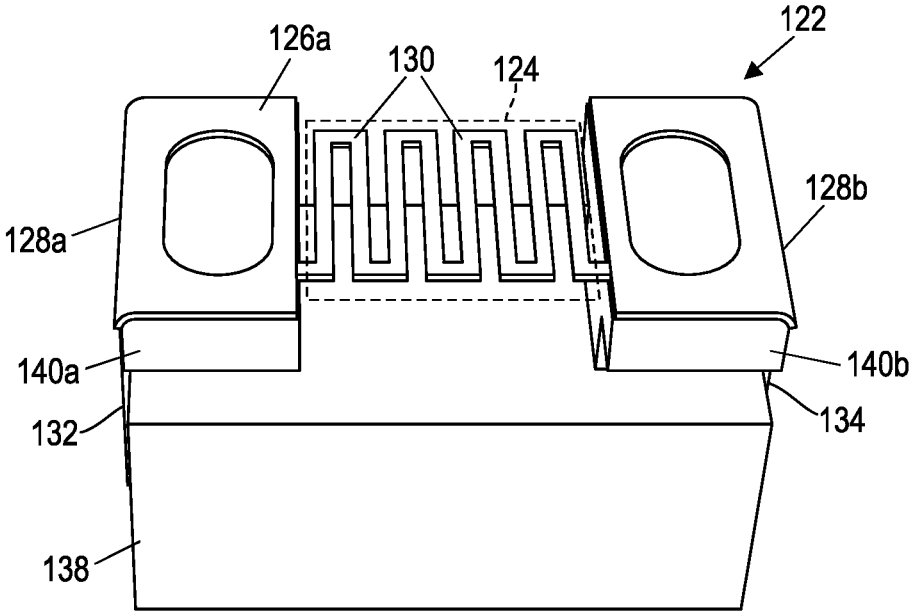
FIG. 6 is a top-down isometric view of the heating element and support structure of FIG. 5.

The vaporizer cartridge 104 includes a reservoir chamber 142 that is configured to hold a vaporizable material (not shown) and a wicking element 144 that is in fluid communication therewith. While the reservoir chamber 142 can have a variety of sizes and shapes, as shown in FIGS. 2 and 6, the reservoir chamber 142 is substantially rectangular in shape. In other embodiments, the reservoir chamber 142 can be shaped and sized differently, including any possible shape.

Figure 7:
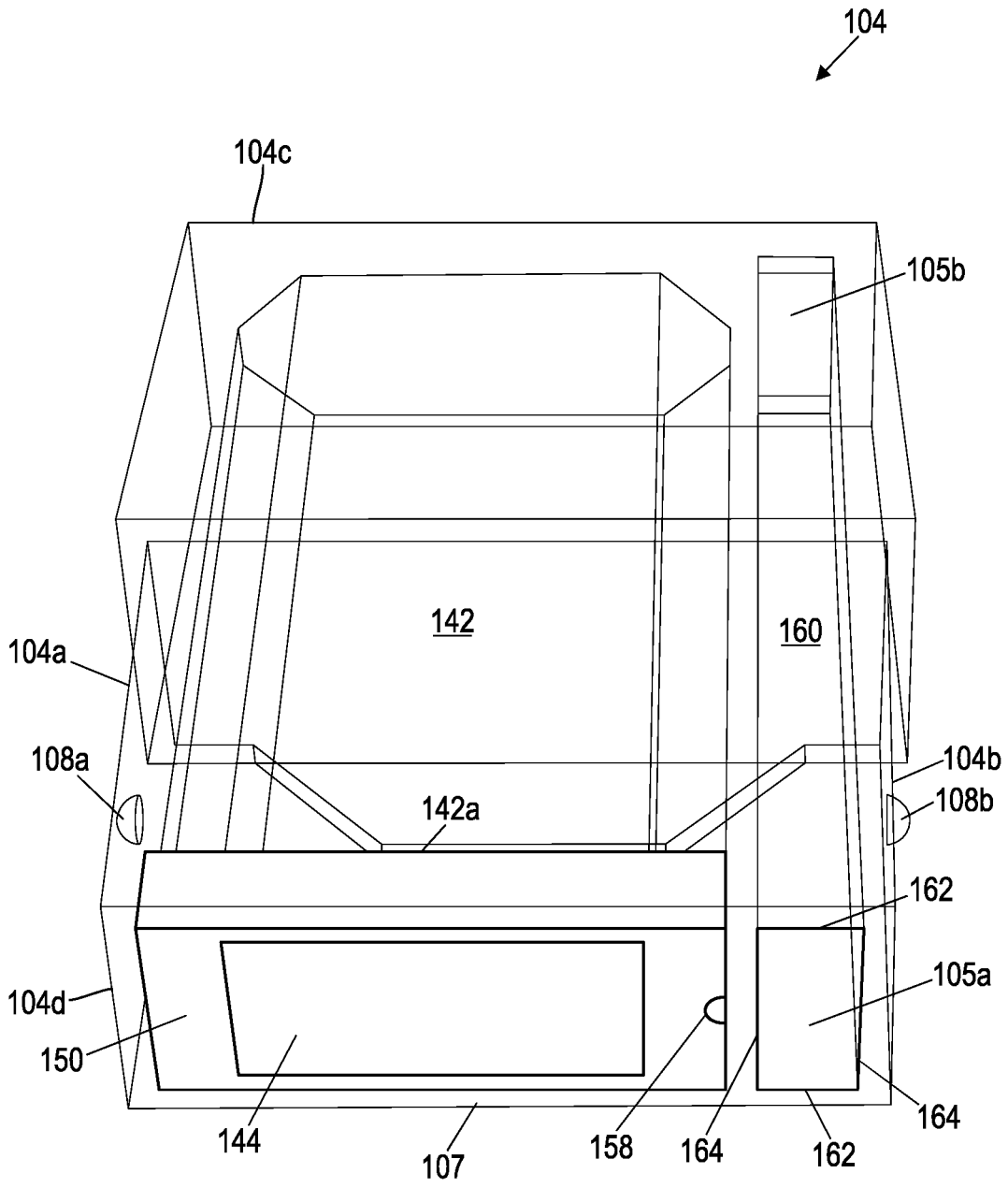
FIG. 7 is a partially transparent, bottom-up isometric view of the vaporizer cartridge of FIGS. 1A-1B.

As shown in FIGS. 2 and 7, the wicking element 144 at least partially resides in a wicking receptacle 146 of a holding plate 150 that is disposed within the vaporizer cartridge 104. While the wicking element 144 can have a variety of configurations, the wicking element 144 is substantially rectangular in shape. In other embodiments, the wicking element 144 can be shaped and sized differently, including any possible shape. The wicking element 144 is configured to draw at least a portion of the vaporizable material from the reservoir chamber 142 for vaporization into the vaporized material.

The holding plate 150 defines a distal end 142*a* of the reservoir chamber 142. The holding plate 150 and the wicking receptacle 146 are shown in more detail in FIG. 8, in which the wicking element 144 has been removed for illustration purposes only. The wicking receptacle 146 includes retaining elements 154 that extend outward from one or more interior sidewalls 148 of the wicking receptacle 146. The retaining elements 154 are configured to maintain at least a portion of the wicking element 144 within the holding plate 150, and thus the vaporizer cartridge 104. In this illustrated embodiment, the retaining elements 154 are substantially triangular in shape.

Figure 8:
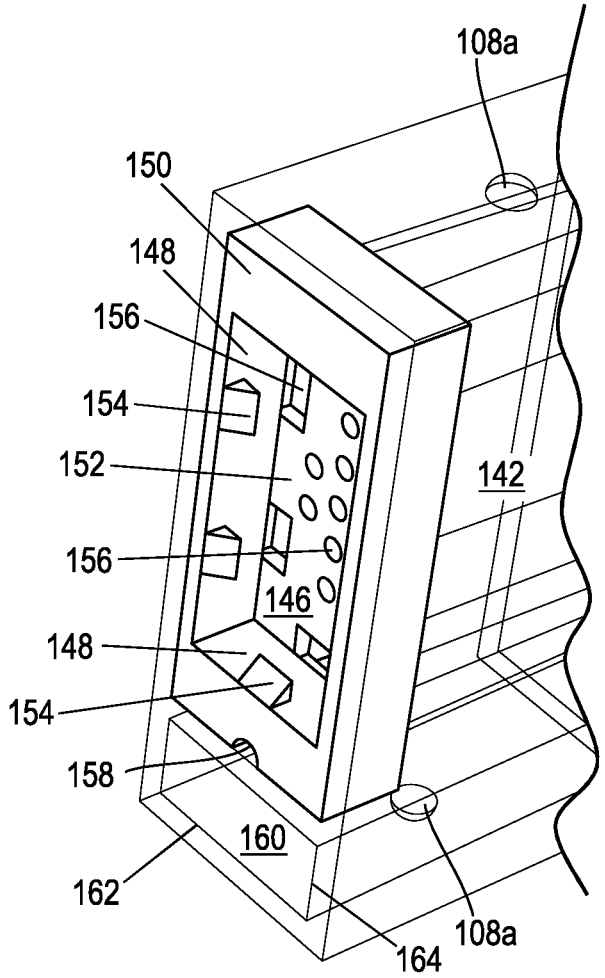
FIG. 8 is a magnified view of a distal facing surface of the vaporizer cartridge of FIG. 7 with the wicking element removed.

As further shown in FIG. 8, the holding plate 150 includes dispensing holes 156 that extend through a top wall 152 of the holding plate 150 that allows the vaporizable material to be drawn from the reservoir chamber 142 and into the wicking element 144 (e.g., via capillary action). As the wicking element 144 receives vaporizable material, the wicking element 144 can increase in size, thereby causing at least a portion of the wicking element 144 to project outward from a distal surface 107 of the vaporizer cartridge 104. Further, the holding plate 150 includes at least one vent 158 extending therethrough. The at least one vent 158 is configured to allow at least a portion of the air traveling along the first airflow path 118 to enter the reservoir chamber 142. As such, the negative pressure that is created within the reservoir chamber 142 as the vaporizable material is drawn therefrom can be reduced.

The vaporizer cartridge 104 also includes an internal channel 160 that extends from an inlet 105*a* to an outlet 105*b* of the vaporizer cartridge 104. As shown in FIG. 2, the second airflow path 120 extends through the internal channel 160. The internal channel 160 is configured to direct air and vaporized material through the vaporizer cartridge 104 and out of the outlet 105*b* for inhalation by a user. While the internal channel 160 can have a variety of configurations, the internal channel 160, as shown in FIGS. 7-8, is defined by two sets of opposing sidewalls 162, 164. In other embodiments, the internal channel 160 can be sized and shaped, including any other possible shape.

In use, once the vaporizer cartridge 104 is coupled to the vaporizer device 100, the heating element 122 is activated by a user puffing on the end 104*c* and at least a portion of vaporizable material within the wicking element 144 is vaporized into vaporized material. This puffing also concurrently draws ambient air 116 into the vaporizer body 102 through the air inlet 114 of the sleeve 110. The vaporized material joins the air traveling along the first airflow path 118, in which at least a portion of the joined vaporized material and air continues to travel through the vaporizer body 102 and into the second airflow path 120 of the vaporizer cartridge 104. As the joined vaporized material and air travel through at least the second airflow path 120, and thus, the internal channel 160 of the vaporizer cartridge 104, they at least partially condense into aerosol for subsequent inhalation by a user.

Terminology

For purposes of describing and defining the present teachings, it is noted that unless indicated otherwise, the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments and implementations only and is not intended to be limiting. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the teachings herein. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The disclosed subject matter has been provided here with reference to one or more features or embodiments. Those skilled in the art will recognize and appreciate that, despite of the detailed nature of the exemplary embodiments provided here, changes and modifications may be applied to said embodiments without limiting or departing from the generally intended scope. These and various other adaptations and combinations of the embodiments provided here are within the scope of the disclosed subject matter as defined by the disclosed elements and features and their full set of equivalents.

What is claimed is:

1. A vaporizer device, comprising:

a vaporizer body including a cartridge receptacle, a heating element, and a first airflow path, the heating element being disposed within the cartridge receptacle and affixed to the vaporizer body;

a cartridge that is selectively coupled to and removable from the vaporizer body, the cartridge including a reservoir chamber configured to contain a vaporizable material and a wicking element that is in fluid communication with the reservoir chamber, the wicking element being configured to draw at least a portion of the vaporizable material from the reservoir chamber; and a support structure that is affixed to the vaporizer body, herein the heating element is coupled to at least a portion of the support structure, the support structure includes a base and two opposing legs extending from the base which define a portion of the first airflow path;

wherein the heating element includes a heating portion that extends from a first surface to a second surface, the first surface facing the wicking element and the second surface facing away from the wicking element, the wicking element and at least a portion of the first surface of the heating element are brought into direct contact with each other in response to at least a portion of the cartridge being seated within the cartridge receptacle such that at least a portion of the vaporizable material received within the wicking element is substantially vaporized to form vaporized material in response to activation of the heating element;

wherein the portion of the first airflow path extends below the second surface of the heating portion of the heating element.

2. The vaporizer device of claim 1, wherein the cartridge includes a second airflow path that is in fluid communication with the first airflow path.

3. The vaporizer device of claim 1, wherein the vaporizer body includes at least one inlet that is configured to substantially allow airflow to pass into the vaporizer body, and wherein the at least one inlet is in fluid communication with the first airflow path.

4. The vaporizer device of claim 1, wherein the heating element includes tines that extend between a first end to a second end of the heating portion, wherein the tines are spaced relative to each other to create one or more holes through the heating element.

5. The vaporizer device of claim 2, wherein the second airflow path extends from an inlet to an outlet of the cartridge.

6. The vaporizer device of claim 1, wherein the heating element includes one or more holes extending therethrough, thereby allowing the vaporized material to travel through the heating element.

7. The vaporizer device of claim 1, wherein each of the two opposing legs is formed in a substantially T-shaped configuration.

8. The vaporizer device of claim 1, wherein the cartridge includes at least one vent that is configured to allow airflow to pass into the reservoir chamber.

9. The vaporizer device of claim 1, wherein the cartridge includes a holding plate having a wicking receptacle defined therein, and wherein the wicking element is at least partially disposed within the wicking receptacle.

10. The vaporizer device of claim 9, wherein the holding plate includes at least one dispense opening that extends through a wall thereof to allow at least a portion of the vaporizable material within the reservoir chamber to pass therethrough and into the wicking receptacle.

11. The vaporizer device of claim 9, wherein the holding plate includes at least one retaining element that is configured to secure the wicking element to the wicking receptacle.

12. The vaporizer device of claim 9, wherein the holding plate includes at least one vent extending therethrough, and wherein the at least one vent is configured to allow airflow to pass into the reservoir chamber.

13. A cartridge for a vaporizer device, comprising:

a reservoir chamber configured to contain a vaporizable material;

a wicking element that is in fluid communication with the reservoir chamber, the wicking element being configured to draw at least a portion of the vaporizable material from the reservoir chamber; and a holding plate having a wicking receptacle defined therein, the wicking element being at least partially disposed within the wicking receptacle;

wherein the wicking element is configured to be brought into contact with at least a portion of a heating element that is affixed to a vaporizer body such that at least a portion of the vaporizable material received within the wicking element is substantially vaporized to form vaporized material in response to activation of the heating element;

wherein the holding plate includes at least one dispense opening that extends through a wall thereof to allow at least a portion of the vaporizable material within the reservoir chamber to pass therethrough and into the wicking receptacle.

14. The cartridge of claim 13, wherein the holding plate defines a portion of the reservoir chamber.

15. The cartridge of claim 13, wherein the holding plate includes at least one retaining element that is configured to secure the wicking element to the wicking receptacle.

16. A cartridge for a vaporizer device, comprising:

a reservoir chamber configured to contain a vaporizable material;

a wicking element that is in fluid communication with the reservoir chamber, the wicking element being configured to draw at least a portion of the vaporizable material from the reservoir chamber; and a holding plate having a wicking receptacle defined therein, the wicking element being at least partially disposed within the wicking receptacle, wherein the holding plate includes at least one vent extending therethrough, and wherein the at least one vent is configured to allow airflow to pass into the reservoir chamber;

wherein the wicking element is configured to be brought into contact with at least a portion of a heating element that is affixed to a vaporizer body such that at least a portion of the vaporizable material received within the wicking element is substantially vaporized to form vaporized material in response to activation of the heating element.

17. The cartridge of claim 16, wherein the holding plate defines a portion of the reservoir chamber.

18. The cartridge of claim 16, wherein the holding plate includes at least one dispense opening that extends through a wall thereof to allow at least a portion of the vaporizable material within the reservoir chamber to pass therethrough and into the wicking receptacle.

19. The cartridge of claim 16, wherein the holding plate includes at least one retaining element that is configured to secure the wicking element to the wicking receptacle.

* * * * *